United States Patent [19]

Baumert

[11] 4,368,877

[45] Jan. 18, 1983

[54] SYSTEM FOR MONITORING SLAG THICKNESS AND CONSISTENCY IN REFINING CRUCIBLE

[75] Inventor: Jean Baumert, Esch-sur-Alzette, Luxembourg

[73] Assignee: Arbed S.A., Luxembourg, Luxembourg

[21] Appl. No.: 188,572

[22] Filed: Sep. 18, 1980

[30] Foreign Application Priority Data

Sep. 29, 1979 [LU] Luxembourg ..... 81740

[51] Int. Cl.[3] ..... C21B 7/24

[52] U.S. Cl. ..... 266/99; 73/591; 75/60

[58] Field of Search ..... 266/99; 75/60; 73/591

[56] References Cited

U.S. PATENT DOCUMENTS

| | | | |
|---|---|---|---|
| 3,533,778 | 10/1970 | Nilles | 75/60 |
| 3,663,204 | 5/1972 | Jungwirth | 75/60 |
| 3,799,763 | 3/1974 | Dortenzo | 75/60 |
| 4,040,819 | 8/1977 | Rounds | 75/60 |
| 4,098,128 | 7/1978 | Baumert | 73/591 |
| 4,135,915 | 1/1979 | Kennard | 75/60 |
| 4,149,877 | 4/1979 | Claes | 75/60 |

*Primary Examiner*—P. D. Rosenberg
*Attorney, Agent, or Firm*—Karl F. Ross

[57] ABSTRACT

A steel refining system has a crucible having an upwardly open mouth and containing a steel melt covered by slag, an oxygen lance directed downwardly into the mouth at the melt, a hood fitting downwardly over the mouth and having a hood wall formed by a multiplicity of coolant tubes, and an arrangement for circulating a coolant through these tubes. The tubes form a tubular hood-wall extension that has an outer end and is centered on an axis trained on the melt on the crucible. A holder is mounted on the outer end of this extension and contains a sound transducer carried by the holder and directed along the axis at the melt. A circuit is connected to this transducer for determining slag thickness by means of the sound detected by the transducer. The holder itself comprises a circularly annular hollow cell fixed by means of a collar to the extension and a transducer housing that is fixed to this cell and therethrough to the extension. The cell defines a passage aligned with the axis and is connected to a separate coolant circuit to prevent overheating of the transducer.

18 Claims, 3 Drawing Figures

SYSTEM FOR MONITORING SLAG THICKNESS AND CONSISTENCY IN REFINING CRUCIBLE

FIELD OF THE INVENTION

The present invention relates to a system for monitoring slag thickness and consistency in a refining crucible.

BACKGROUND OF THE INVENTION

The thickness of the slag in a refining crucible is important because it shows how far the refining operation has progressed. Furthermore its upper level must be monitored to prevent the crucible from overflowing. To this end my earlier U.S. Pat. No. 4,098,128 describes a system wherein an acoustic tube having several resonant frequencies is directed into the mouth of the refining crucible and is heated to above 100° C. A microphone at the remote end of this tube receives sound passing through the tube and generates an electrical output corresponding to the sound received. This electrical output is delinearized over a band width including several of the resonant frequencies of the tube and the signal is then passed through a low-pass filter to eliminate parasitic oscillations and through a mixer where it is combined with a signal from a local oscillator. The intermediate frequency thus produced is passed through either of a pair of band-pass filters and is displayed. The signal strength of the output is inversely proportional to the depth of slag in the crucible, as the deeper the slag the more sound is absorbed by it.

The original source of the sound that is measured by this system is from the oxygen lance also directed at the surface of the melt in the crucible. The information obtained not only indicates the depth or thickness of the slag layer, but also its consistency.

Normally the acoustic tube with its microphone is mounted outside the crucible so as to reduce as much as possible the danger of it becoming damaged by material bubbling up in the melt. Thus such an arrangement is only usable adjacent a single crucible to which oxygen is being fed via its respective lance. In a plant where several such crucibles are operated simultaneously adjacent one another the above-described system operates imperfectly as it picks up noises in the appropriate frequency range from the adjacent crucibles.

The above-described system also has the disadvantage when used with a top-blown vessel having a hood such as described on pages 486 ff of The Making, Shaping and Treating of Steel edited by H. McGannon (Herbick & Held: 1971) that it is practically impossible to provide a safe mount for the acoustic tube and microphone. The hood must form a more or less tight joint with the stack and with the top of the crucible, normally by means of a skirt closed around the top of the crucible by hydraulic cylinders. In such systems it is essential to prevent air from entering the crucible during the blow as well as to prevent the dangerous post-combustion gases, such as carbon monoxide, from leaking out during the refining operation. This hood is normally provided with, or is in fact formed by, an array of tubes through which water is circulated to keep exhaust-gas temperatures down and to prevent the often chemically active stack gases from reacting with and damaging the hood.

OBJECTS OF THE INVENTION

It is therefore an object of the present invention to provide an improved system for monitoring slag in a refining crucible.

Another object is to provide such a system which works not only with a crucible operating simultaneously adjacent several other crucibles, but also with a crucible which has a hood normally tightly closed over it.

SUMMARY OF THE INVENTION

These objects are attained according to the instant invention in a system wherein the tubes forming the hood wall also together form a tubular extension that has an outer end that is centered on an axis trained downwardly on the center of the upper surface of the melt. A collar carrying a double-wall annular cell is mounted on the outer end of this extension and carries a housing for a sound transducer. This transducer is normally a microphone and is connected to circuitry having filters for eliminating sounds not relevant to the determining of the slag thickness and other appropriate amplifier circuitry.

The basic idea of this invention is to provide an acoustic sound-trapping system which can work even inside systems whherein considerable heat is generated. By providing the cooled surrounding for the transducer according to this invention it is possible to mount it in an area where temperatures above 1000° C. are encountered, something otherwise completely impossible as these temperatures would destroy any normal sound-transducing equipment. This arrangement can be used with a relatively tightly sealed refining crucible, or merely with one provided with a relatively loosely fitting hood for trapping gases rising from the melt.

The housing which holds the sound transducer is connected to the circular cell, normally with interposition of an annular elastomeric seal so as to reduce transmission of vibration between the two parts. According to this invention it is possible to provide a sound-transmitting element constituted as a disk between the housing and the cell. The central part of this disk has a hole and is provided with a tubular extension projecting toward the melt, centered on the axis, and flared toward the melt. This flared extension lies in the passage defined by the annular circular cell. The above-described elastomeric seal lies between this disk and the housing.

The transducer according to this invention comprises a microphone. It is possible to provide this microphone at the remote or outer end of an acoustic tube centered on the axis. The inner end of this acoustic tube lies adjacent the passage through the cell. Thus the microphone can be well out of harm's way, especially by providing an acoustic tube having a length of greater than 3 m. In such an arrangement a linearization filter is needed to eliminate sounds having the same resonant frequency as that of the acoustic tube.

It is also possible according to this invention to mount the microphone directly in the housing immediately adjacent the sound-transmitting element. To this end the housing includes a short tube which contains the microphone and which is plugged at its end turned toward the sound-transmitting element by a steel perforated plug. Also according to this invention a brass membrane having a thickness of no more than 0.1 mm and provided on its face turned toward the melt with a vapor-deposited quartz layer may be employed to further protect the microphone. The plug protects the membrane from the heat of the melt and the membrane protects the microphone in its turn from dust. Spacers are provided to maintain exact distances between the membrane and the microphone as well as between the membrane and the plug. Such spacers eliminate the need for recalibrating the system once it has been assembled.

The housing which contains the sound transducer is cooled, according to this invention, by means of a neutral gas such as nitrogen. This gas is introduced into the remote portion of the housing and exits through the hole in the sound-transmitting element, becoming eventually mixed with the stack gases that are aspirated through the hood. To this end the flared tubular extension of the sound-transmitting membrane acts as a venturi, preventing sudden speed variations and direction changes in the gas which could create parasitic noises. In addition to cooling the housing and the microphone this gas also eliminates powder and the like from the device according to this invention while keeping flames away from it, as nitrogen will not support combustion in stack gases.

In the arrangement where the microphone is mounted directly adjacent the sound-transmitting element the housing has a double wall which is cooled with water. This water is relatively cold, approximately 10° C. This temperature is substantially lower than the temperature of 50° C. of the water which is circulated in the tubes which form all the hood walls and extension. Similarly the cell has, as described above, a double wall inside of which cooling water is circulated. The collar mounting the cell on the extension of the hood may also be of double-wall construction and cooled, but preferably by means of a gas such as nitrogen.

SPECIFIC DESCRIPTION

Figure 1:
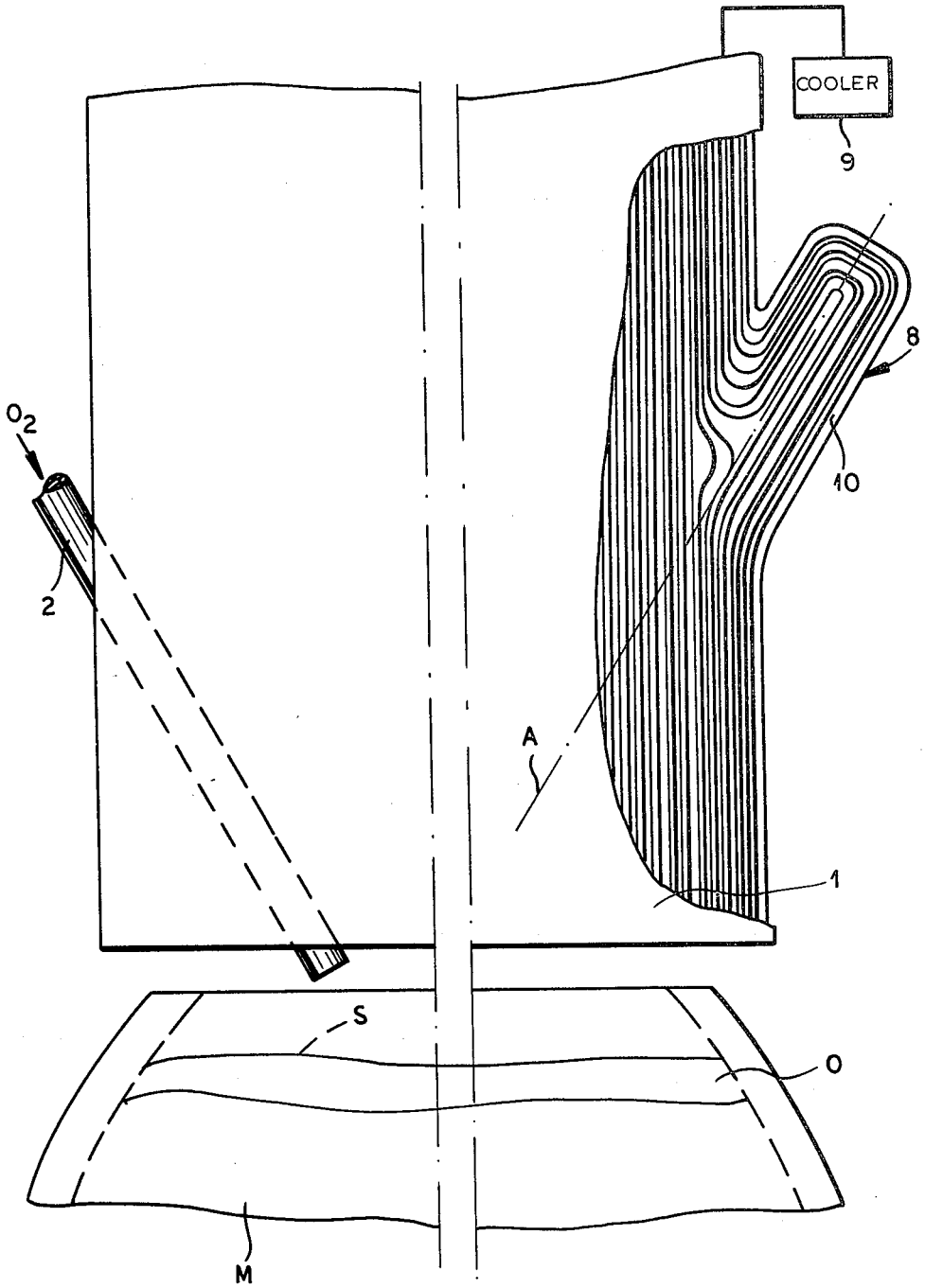
FIG. 1 is a side partly sectional and partly schematic view showing the hood and crucible structure of a system according to the instant invention.

As shown in FIG. 1 a steel-refining crucible O contains a melt M of steel surmounted by a layer of slag S. A lance 2 serves for injecting oxygen into the crucible O for refining the steel of the melt M.

According to this invention a hood 1 is provided above the crucible O and has walls formed entirely of cooling tubes 10 through which water at approximately 50° C. is circulated from a cooler 9. These tubes 10 together form at one side of the hood 1 a cylindrical and tubular extension 8 centered on an axis A directed downwardly at the center of the top of the melt M.

Figure 2:
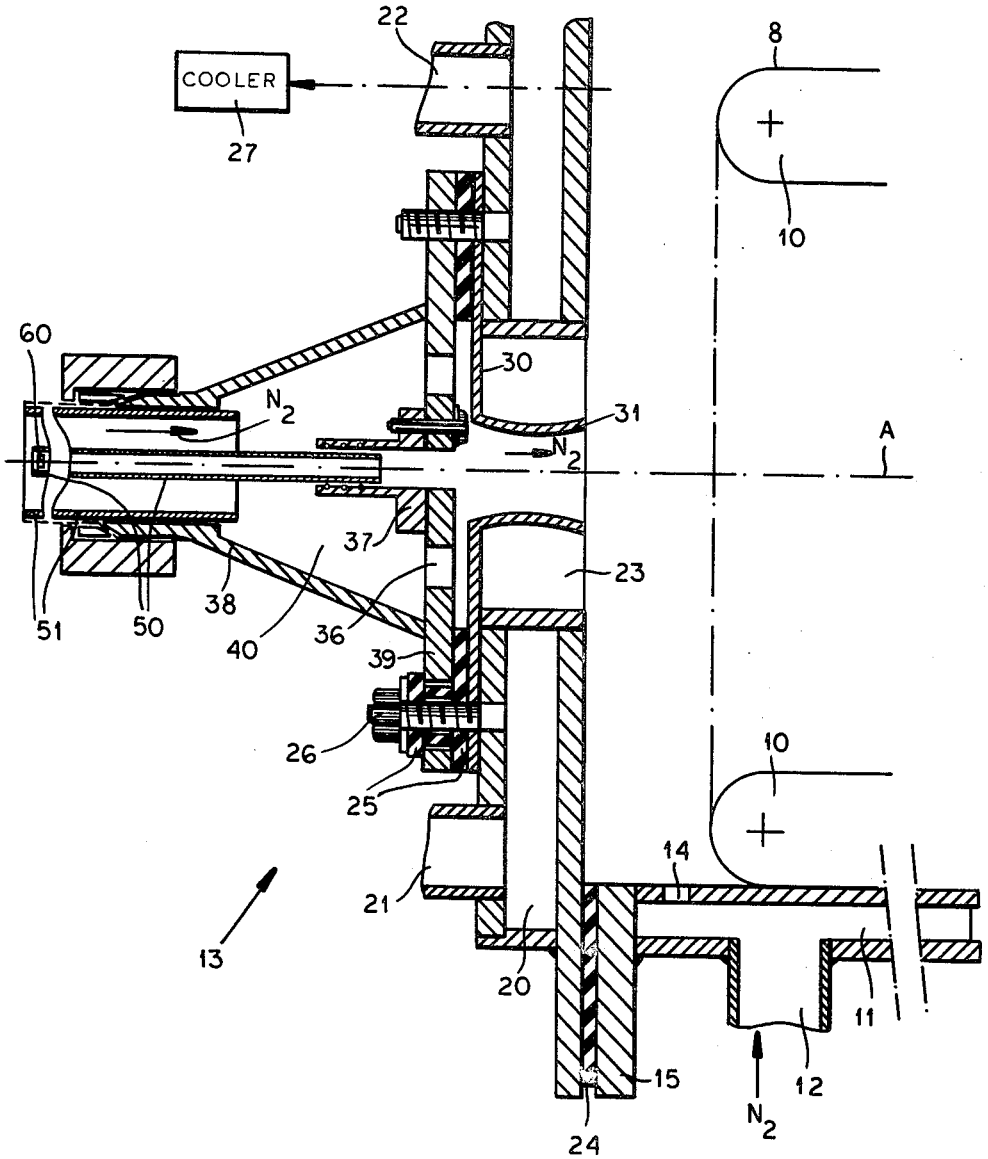
FIG. 2 is an axial section through the improvement according to the present invention.

FIG. 2 shows how mounted on the tubular extension 8 is an apparatus 13 basically having a double-walled annular sleeve or collar 11 fitted snugly around the extension 8, a double-walled cell 20, and a housing 40. The sleeve or collar 11 is provided with an inlet 12 by means of which gas, normally nitrogen, is injected into this sleeve 11. This gas can escape into the interior of the extension 8 through radially inwardly opening holes 14 formed in the inner wall of the double-walled sleeve 11.

The annular double-walled cell 20 is secured via bolts and an elastomeric seal 24 to a flange 15 of the sleeve 11 and has an inlet 21 and an outlet 22 for water from another cooler 27. The annular cell 20 forms a central hole or passage 23 centered on the axis A.

A sound-transmitting disk 30 is clamped by bolts 26 along with an annular cushion seal 25 to the outer wall of the double-wall cell 20. This disk 30 is formed centrally with a double-flared tubular extension 31 centered on the axis A and forming a venturi.

The housing 40 has a flange 39 secured via the bolts 26 to the seal 25 which in turn clamps the disk 30 to the outer wall of the cell 20. Extending backwardly away from this flange 39 is a frustoconical portion 38 in which is seated a large-diameter tube 51 centered on the axis A and coaxially receiving a central acoustic tube 50 fitted at its' front end in a collar 37 fixed to the flange 38 which itself is formed with throughgoing holes 36. The far end of the acoustic tube 50 receives a microphone 60. Nitrogen is admitted into the space between the tubes 50 and 51 at the far end where the microphone 60 is provided so that this nitrogen flows forwardly, through the hole 36, and then out through the projection 31 into the extension 8. The tube 50 is at least 3 m long between its outer end provided with the microphone 60 and its inner end at the passage 23. The hole 23 has a diameter of approximately 100 mm.

Figure 3:
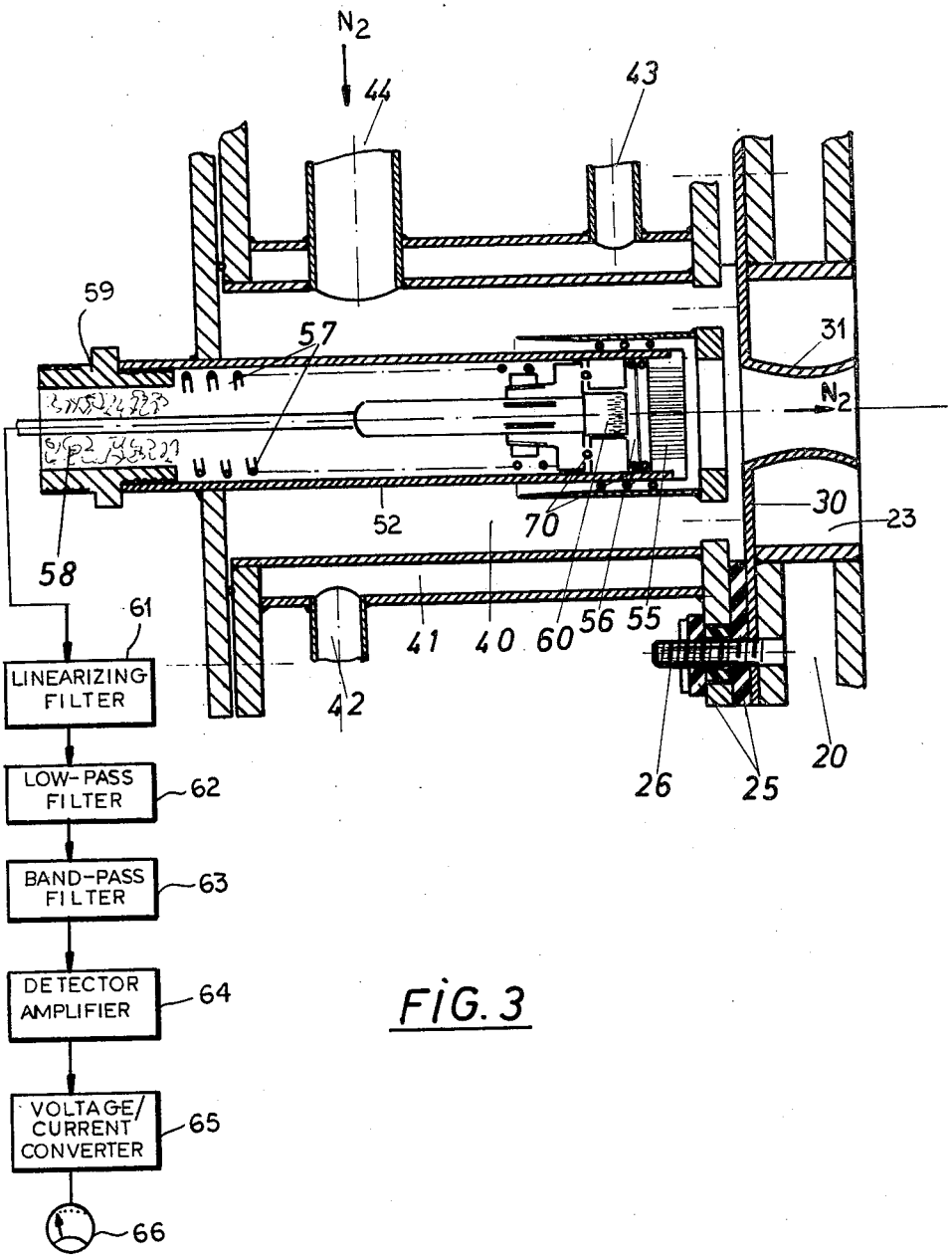
FIG. 3 is a view similar to FIG. 2 showing another arrangement according to this invention with the circuit for the apparatus shown schematically.

FIG. 3 shows another arrangement according to this invention wherein the microphone 60 is mounted directly in a housing 40 which is double jacketed so as to have an external chamber 41 provided with a cooling-water inlet 42 and outlet 43 similar to the inlet and outlet 21 and 22. This structure is necessary, since the microphone 60 is at an otherwise very hot location. In addition the microphone 60 is here shown mounted in a tube 52 that is relatively short compared to the tube 51 of FIG. 2, the microphone 60 being immediately adjacent the passage 23. The front end of this tube 52 is provided with a perforated steel plug 55 and spaced slightly behind this plug 55 with a thin brass membrane 56 coated on its front face with quartz. Spacers 70 are provided to maintain exact spacings between the microphone 60, membrane 56, and plug 55. A spring 57 holds the microphone in its forward position, however, a nut 61 can be removed from the rear end of the tube 52 to allow the microphone 60 to be withdrawn if necessary.

With the system according to the instant invention it is therefore possible to provide the microphone right in the hood for a crucible, whether this hood be of the tightly fitting type or the type that merely is provided above the crucible. In the event it is in the latter type of hood the system according to the instant invention can be used adjacent other crucibles without the sounds from the one crucible interfering with those of the others, so that accurate readings will be obtained.

FIG. 3 shows a circuit similar to that shown in FIG. 2 of my above-described patent. The microphone 60 may be connected through a linearizing filter 61, which may be dispensed with as such is normally only needed with an acoustic tube, then through a low-pass filter 62, a band-pass filter 63, a detector/amplifier 64, and a voltage/current converter 65 to a readout device 66. For further details of this circuit reference should be made to my above-cited patent.

I claim:

1. In a steel-refining system having:

a crucible having an upwardly open mouth and containing a steel melt covered by slag, an oxygen lance directed downwardly into said mouth at said melt, a hood fitting downwardly over said mouth and having a hood wall formed by a multiplicity of tubes, and means for circulating a coolant through said tubes, the improvement comprising:

a tubular hood-wall extension formed by said tubes, having an outer end, and centered on an axis trained on said melt;

a holder mounted on said outer end of said extension;

a sound transducer carried by said holder and directed along said axis at said melt; and circuit means connected to said transducer for determining slag thickness by means of the sound detected by said transducer.

2. The improvement defined in claim 1 wherein said transducer is a microphone and said circuit means includes filters for eliminating from the sound transduced sounds not relevant to the determining of said slag thickness.

3. The improvement defined in claim 2 wherein said holder includes a circularly annular hollow cell fixed to said extension and a transducer housing fixed to said cell and therethrough to said extension, said cell defining a passage aligned with said axis.

4. The improvement defined in claim 3, further comprising a sound-transmitting element between said microphone and said cell.

5. The improvement defined in claim 4 wherein said element is a disk secured between said housing and cell and having a central hole and a tubular projection flared toward said melt and centered on said axis.

6. The improvement defined in claim 5, further comprising a cushion seal between said disk and said housing.

7. The improvement defined in claim 6 wherein said housing includes a relatively long acoustic sound-transmitting tube extending along said axis and having an inner end at said passage and an outer end remote from said passage and carrying said microphone.

8. The improvement defined in claim 6 wherein said microphone is mounted relatively close to said element.

9. The improvement defined in claim 8 wherein said housing includes a relatively short tube holding said microphone and including a perforated plug between said microphone and said passage.

10. The improvement defined in claim 9, further comprising a thin membrane between said plug and said microphone.

11. The improvement defined in claim 10, further comprising spacer braced between and defining fixed spacings between said tube, microphone, plug, and membrane.

12. The improvement defined in claim 3, further comprising means for introducing a coolant gas into said housing whereby said gas escapes from said housing through said passage.

13. The improvement defined in claim 3, further comprising means for cooling said housing with a liquid colder than 15° C.

14. The improvement defined in claim 3, further comprising means for cooling said cell with a liquid.

15. The improvement defined in claim 3, further comprising a collar attached to said cell and surrounding said extension.

16. The improvement defined in claim 15, further comprising means for cooling said collar.

17. The improvement defined in claim 15, further comprising means for cooling said collar with a gas.

18. In a steel-refining system having:

a crucible having an upwardly open mouth and containing a steel melt covered by slag, an oxygen lance directed downwardly into said mouth at said melt, a hood fitting downwardly over said mouth and having a hood wall formed by a multiplicity of tubes, and means for circulating a coolant at a relatively high temperature through said tubes, the improvement comprising:

a tubular hood-wall extension formed by said tubes, having an outer end, and centered on an axis trained on said melt;

an at least partially hollow holder mounted on said outer end of said extension;

a sound transducer carried by said holder and directed along said axis at said melt;

means for circulating a coolant at a relatively low temperature through said holder and thereby cooling said transducer; and circuit means connected to said transducer for determining slag thickness by means of the sound detected by said transducer.

* * * * *